United States Patent [19]

Nystrand

[11] 4,279,411

[45] Jul. 21, 1981

[54] METHOD OF LAPPING WEBS

[75] Inventor: Ernst D. Nystrand, DePere, Wis.

[73] Assignee: Paper Converting Machine Company, Green Bay, Wis.

[21] Appl. No.: 67,881

[22] Filed: Aug. 20, 1979

Related U.S. Application Data

[63] Continuation-in-part of Ser. No. 49,287, Jun. 18, 1979, abandoned, which is a continuation of Ser. No. 871,236, Jan. 23, 1978, Pat. No. 4,163,548.

[51] Int. Cl.[3] ..... B41L 1/32

[52] U.S. Cl. ..... 270/39; 493/433

[58] Field of Search ..... 270/39, 73

[56] References Cited

U.S. PATENT DOCUMENTS

| | | | |
|---|---|---|---|
| 1,219,238 | 3/1917 | Brown | 270/39 |
| 1,228,400 | 6/1917 | Brown | 270/39 |
| 1,436,302 | 11/1922 | Wheeler | 270/39 |
| 4,163,548 | 8/1979 | Nystrand | 270/39 |

*Primary Examiner*—Edgar S. Burr
*Assistant Examiner*—A. Heinz
*Attorney, Agent, or Firm*—Tilton, Fallon, Lungmus & Chestnut

[57] ABSTRACT

A method of lapping webs wherein two series of web sections are advanced, reversely folding a portion of each section about a transverse line adjacent the section leading edge to lap a portion of the preceding section adjacent the trailing edge, and retarding one series relative to the other.

3 Claims, 3 Drawing Figures

10'
27
12'
26'
W'
R
25'
11'
13'a
13'
23'
30'
14'
36
W
26
35
10
27
12
11
25
16
13a
24
2
15
20
19
23
13
2
14
32'
32
33'
33
G
34'
34
T

Fig. 2
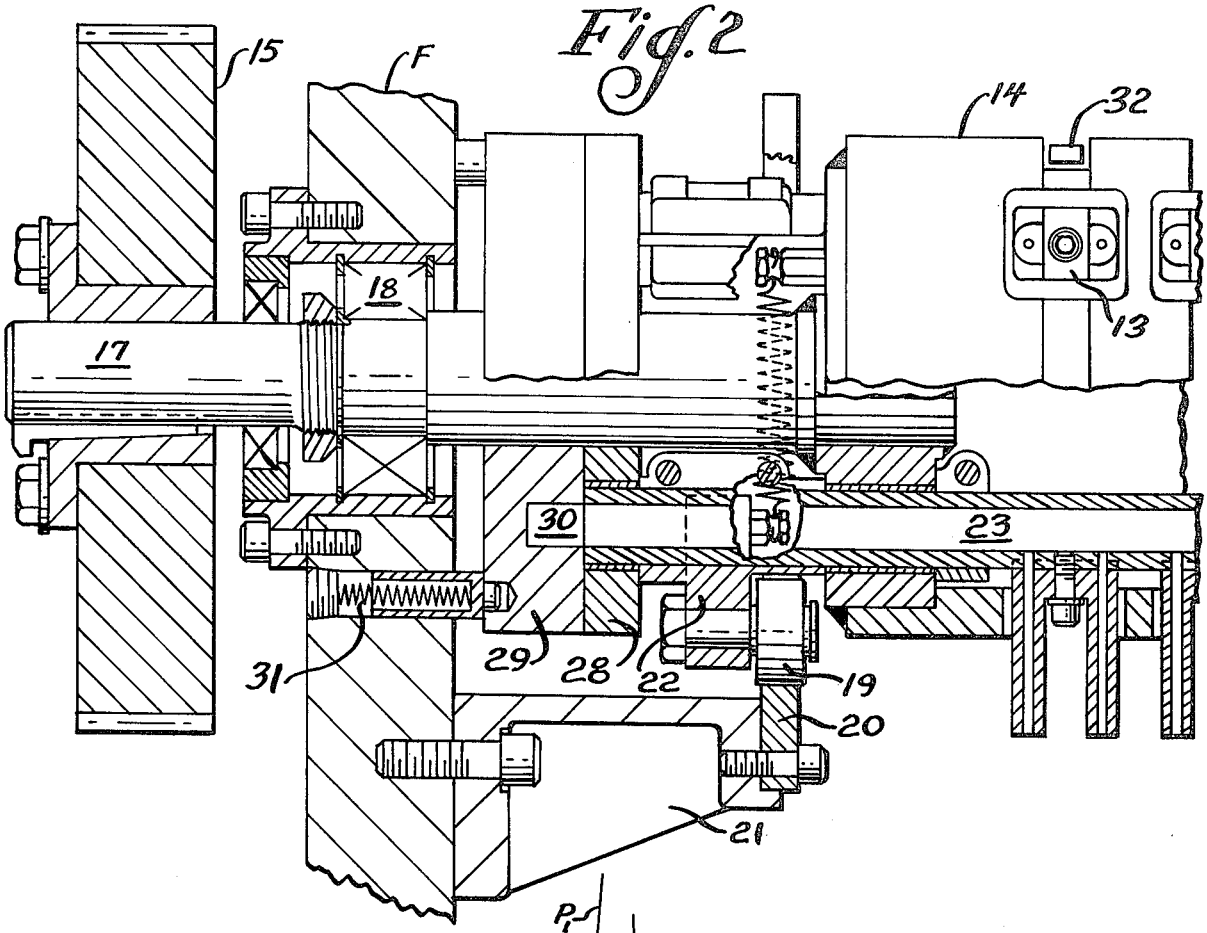
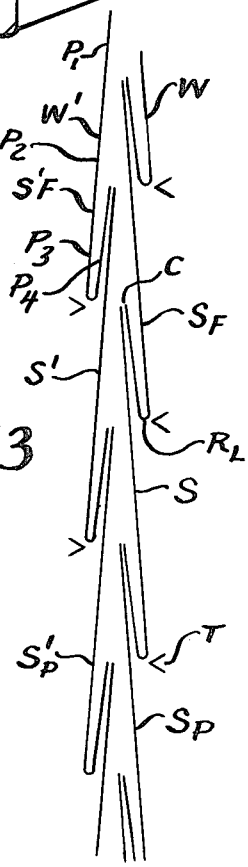
Fig. 3

METHOD OF LAPPING WEBS

This is a continuation-in-part of my co-pending application Ser. No. 49,287, filed June 18, 1979 (now abandoned) which, in turn was a continuation of my co-pending application Ser. No. 871,236, filed Jan. 23, 1978, now U.S. Pat. No. 4,163,548.

BACKGROUND AND SUMMARY OF INVENTION:

This invention relates to a method of lapping webs and the product resulting therefrom and, more particularly, to webs which thereafter can be further processed as by zig-zag folding or rewinding.

In the earlier above-identified applications, the solution of a 30 year problem of increasing the output of multi-fold machines by doubling the number of parent rolls to equal the single fold machines in production was achieved through the use of double three leaf multifold. More particularly, this was an improvement on the method of producing interfolded products where one or two parent rolls were employed and the folds introduced transversely of the unwound web and the resultant sheets dispensed in the stronger machine direction of the paper machine. This was in contrast to the other method of producing interfolded products where the webs were folded longitudinally (requiring 200+parent rolls for a 200 count package) and which were dispensed in the weaker cross machine direction.

In the earlier applications, webs from two parent rolls were separately cut to discrete sheets, each web having its own lapping system and thereafter the lapped sheets from the two individual parent rolls are brought together in a staggered reverse relationship whereby all of the exposed edges face one direction. The combined webs could then be zig-zag folded as in the convention system or, alternatively, rewound for sequential dispensing.

One possible draw-back of the invention using the double three leaf multi-fold was the fold-back of the leading edge of each sheet which could be objectionable in softer tissues.

One possible solution was to encourage the fold-back, as has been in the high speed bedroll for rewinders—as in U.S. Pat. No. Re. 28,353. Here it was not appealing, as the additional thickness of the folded edges would tend to produce a horseshoe shaped package, extremely difficult to package. Notwithstanding this apparent draw-back, the instant invention involved going beyond this point and, by adding another leaf or panel, transfers a full panel away from the leading, cut edge. Thus, it is possible to have 5 or more panels instead of 4, but from what has been seen so far 4 panels are optimal.

Contrary to the 3-leaf multi-fold, with the 4 leaf version, there is no need to break any bonds from a shear-cut severing of the sheet. For facial tissue, dispensed upward from a carton, small bonds (no the order of 0.012") should be a distinct advantage when higher counts in deeper cartons are used. However, if bonds are not desired in the final product, it is a simple matter to break the bonds before transfer.

According to the instant invention, webs from two parent rolls are weakened, i.e., either perforated or completely cut. Then no more than ¼ of the leading edge portion—extending back from the line of weakness—is reversely folded—after which the web sections from each web are lapped and combined as in the 3-leaf multi-fold.

DETAILED DESCRIPTION

Figure 1:
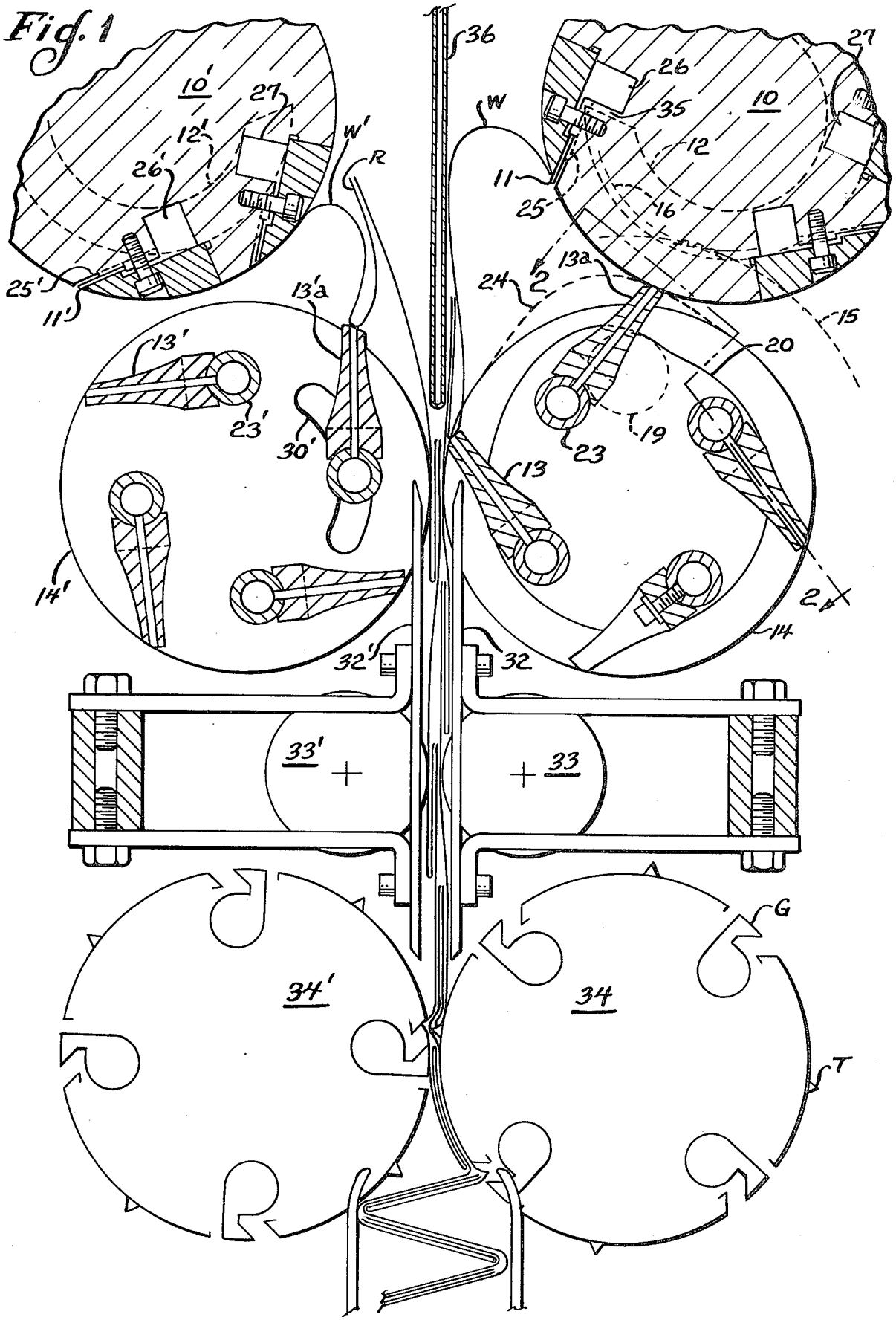

The invention is described in conjunction with an illustrative embodiment in the accompanying drawing, in which FIG. 1 is a schematic end elevational view of apparatus which can be used advantageously in the practice of the invention;

FIG. 2 is a fragementary side elevational view partially in section such as would be seen along the segmented sight line 2—2 as applied to FIG. 1; and FIG. 3 is another schematic view showing the arrangement of sheets as the lapped sheets are combined prior to zig-zag folding.

In view of the fact that many of the machine elements are known art and because these are readily seen in detail in conveniently available reference patents, a minimum of structural detail has been delineated to describe the inventive method. For additional details, reference may be made to the above-mentioned applications as well as U.S. Pat. No. 3,490,762 and the disclosures thereof are incorporated herein by express references.

Consistent with the foregoing, the machine side frames are omitted from the FIG. 1 showing—although a portion of one side frame F is seen in the left hand portion of FIG. 2. In any event, suitable framing is provided to rotatably mount a number of rolls including first a pair of parent rolls (not shown). The web from each parent roll is suitably conducted to a pair of cutoff rolls 10 and 10'. These rolls 10, 10' may advantageously take the form shown in U.S. Pat. No. 2,870,840 where a flexing bed roll blade (as at 11, 11') operates against a stationary anvil (not shown) to cut or perforate as desired. For example, should perforating be desired, the blades 11, 11' are notches at intervals along the length of their cutting edges to produce bonds between slits. Without notching, the web weakening is complete, i.e., a full transverse cut.

The web traveling on the cutoff bed roll 10 is held there against by vacuum exerted through a vacuum chamber 12 and a corresponding function is performed by the vacuum chamber 12' relative to the cut off bed roll 10'. The web W (see the upper central portion of FIG. 1) is removed from the bed roll 10 by means of four sets of vacuum fingers as at 13 provided on the retard or lapping roll 14. The left hand web W' is handled in the same way by means of the four sets of vacuum fingers 13' provided on the retard or lapping roll 14'.

The retard rolls 14 and 14' travel at one-half the speed of the cutoff rolls 10 and 10'—this being achieved by gears 15 and 16 relative to the rolls 14 and 10, respectively. The gear 15 is seen in the left hand portion of FIG. 2 and is mounted on the shaft 17 journalled within bearing 18 supported by frame F. The shaft 17 supports the retard roll 14 and a similar arrangement to that seen in FIG. 2 is provided on the right hand end of the retard roll 14 but which is not shown in FIG. 2.

Returning to FIG. 1, the numeral 19 designates a cam follower which bears against the camming surface of an interior cam 20. As can be seen in the lower central portion of FIG. 2, the interior cam is secured to a bracket cam 21 which in turn is secured to the frame F. The cam follower 19 is mounted on a bracket 22 which in turn is clamped to a vacuum tube 23. The set of vacuum fingers 13 is fixed to the vacuum tube 13 and project radially therefrom. Thus, as the cam follower 19 follows the contour of the interior of cam 20, the vacuum tube 23 and hence the fingers 13 fixed thereto will pivot accordingly.

In the illustration given in the right hand portion of FIG. 1, the uppermost set of fingers 13*a* (the vacuum tube of which might be considered to be the 10:30 o'clock position) is in the process of being pivoted counterclockwise so as to trace the envelope designated 24. This operation results in the tip of the vacuum fingers 13*a* traveling faster than the surface speed of the retard roll 14—in fact, the camming surface of the cam 20 is designed so that the tips of the vacuum fingers 13*a* in the so-called 10:30 o'clock position are traveling at the same rate of speed as the web on the cutoff bed roll 10, i.e., at twice the speed of the retard roll 14.

At this point in time, the vacuum fingers 13*a* take over control of the web W traveling on the cutoff bed roll 10 and carry a portion of that web with them as they continue to rotate. Ultimately, the vacuum fingers 13*a* reach the 7:30 o'clock position illustrated in the right hand portion of FIG. 1 and shortly thereafter the vacuum is removed from the vacuum fingers 13*a*, causing the web to be released. It should be appreciated that each of the retard rolls 14, 14' are equipped with four sets of vacuum fingers each (13 and 13', respectively) and that the sets in one roll are 45° out of phase with respect to the fingers in the other roll. Therefore, the configuration of web between the time it is picked off of the bed roll and the time it is released can be visualized by consideration of the vacuum finger 13'*a* in the 3 o'clock position at the left of FIG. 1. It will be appreciated that the vacuum finger takes over a portion of the web spaced rearwardly (considering the direction of web travel) of the cutoff or perforation achieved by the blades 11, 11'. Thus, there is provided a portion of the web between what might be considered the leading edge (either a fold line developed by perforation or a complete cut developed by a cutoff blade) which is adapted to be reversely folded—as can be appreciated from the portion designated R in the left hand upper portion of FIG. 1.

Before proceeding further with the description of the apparatus depicted in FIGS. 1, 2 and 4, it is believed that the inventive method can be understood better by reference to FIG. 3 which is a schematic representation of web sections from both parent rolls as they would exist without zig-zag folding or other control following reverse folding. Referring now to FIG. 3, the middle right hand section of the web W is designated S while that preceding is designated $S_p$ and that following $S_F$. Similar designations are employed for the three sections made up from the web W' but with the addition of a "prime", viz., $S'_F$, S' and $S'_P$. Each of the sections illustrated is of a length equal to about four panels when ultimately zig-zag folded. This can be appreciated from a consideration of the section $S'_F$ where the panels are designated $P_1$, $P_2$, $P_3$ and $P_4$. It will be noted that the panel $P_4$ is reverse folded relative to the remainder of the section, viz., in lapping relationship to the panel $P_3$. Optimally, the panel $P_4$ should be no greater than the panel $P_3$ and preferably somewhat shorter so that the fold line introduced by the zig-zag folding will not include a portion of the panel $P_4$.

Still referring to FIG. 3, but at the point designated C which is the boundary between the sections $S_F$ and S, it will be appreciated that the web W will appear as illustrated if a cut completely across the sheet occurs at the point C. However, there will be a fold line in transversely spaced apart bonds if the web W instead of being completely cut is only partially cut—as by perforation.

By virtue of the operation of the vacuum fingers 13, a portion of each section rearwardly (or upstream) of the leading edge of each section is gripped to bring about the reverse fold R (alternatively panel $P_4$) which laps a portion of the preceding section adjacent the trailing edge thereof. Here, the terms "leading edge" and "trailing edge" refer to the boundaries of the sections, irrespective of whether the sections are completely separate one from another, or not. In particular, the line of reverse folding $R_L$ is adjacent to but spaced from the leading edge of each section.

From a consideration of FIG. 3, it also will be noted that one series of sections (as from the web W) is retarded relative to the other series of sections (from the web W') so that upon combining the two series, the leading and trailing edges of one series are offset relative to the leading and trailing edges of the other series. Further, a consideration of FIG. 3 reveals that the lapped portions of one series are oriented reversely to the lapped portions of the other series—so that either all of the fold lines $R_L$ are exposed and facing in the same direction or the trailing edges (as at C) are exposed and facing in the same direction, but not both. Also in FIG. 3, certain horizontal V's are illustrated and are designated by the symbol T, being schematic representations of where the tucker tips engage the combined webs, as is more correctly illustrated in FIG. 1.

For convenience in applying vacuum to the webs W and W' when the same are traveling with the cutoff rolls 10 and 10', I provide a plurality of axially spaced apart passages 25 and 25' communicating the roll periphery with axially extending bores 26 (or 26' as the case may be). Each bore 26, 26' communicates with the associated vacuum chamber 12, 12' in the fashion to be described immediately hereinafter relative to the vacuum tubes 23, 23' associated with the retard rolls 14, 14'. Additionally vacuum passages may be provided as at 27 relative to roll 10.

The vacuum fingers 13 and 13' achieve their vacuum through the vacuum tubes 23 and 23', previously mentioned and one of which can be seen in FIG. 2. The four vacuum tubes 23 associated with the retard roll 14 are held in place by end plates as at 28 (see the central lower portion of FIG. 2) and which ride against a stationary member 29 containing a vacuum slot 30. For purposes of simplicity of illustration, only the companion vacuum slot 30' is illustrated in FIG. 1 relative to the retard roll 14', it being appreciated that a similar arcuate slot will be provided for the retard roll 14. A coiled spring 31 is mounted within the frame F (see the lower left hand portion of FIG. 2) to urge the stationary member 29 against the plate 28 and thus avoid air leakage which would tend to break the vacuum.

As each of the vacuum fingers 13 and 13' rotate, the web carried thereon encounters a series of strippers as at 32 and 32' which strip the reversely folded, lapped web from the retard roll 14 or 14' and direct the same between draw rolls 33 and 33'. Thereafter, the combined webs are directed between folding rolls 34 and 34' which are seen to be equipped with tuckers and grippers in the manner described with respect to the above-mentioned applications.

In the operation of the apparatus just described, the web W is about to be released from the periphery of roll 10 by virtue of the fact that the bore 26 is just out of communication with the vacuum chamber 12—see the small area of separation designated 35. Thus a greater length of the web W can fall away from the roll 10—the next rearward portion being urged against the roll by the passages 27. Therefore, it is possible for the fingers 13*a* to take over control of the web W. To assist in directing the webs W and W′ in the proper path, I employ a barrier 36 on the frame F between the rolls 10, 10′ and directed toward the nip between rolls 14, 14′.

While in the foregoing specification a detailed description of an embodiment of the invention has been set down for the purpose of illustration, many variations of the details hereingiven may be made by those skilled in the art without departing from the spirit and scope of the invention.

I claim:

1. A method of lapping sheets comprising advancing an elongated web from each of a pair of parent rolls, tranversely weakening each web along equally longitudinally spaced apart lines to provide discrete identical sections having leading and trailing edges and to form a series of moving sections from each web wherein each series travels on opposite sides of a lineal path and each section of a series lies between a preceding section and a following section, folding a portion of each section about a transverse line adjacent each section's leading edge wherein said folded portion overlies a remaining portion of the section, conveying the respective series of thus folded sections on opposite sides of said lineal path while orienting said remaining portion of a preceding section to lie between the said lineal path and the associated transverse fold line of a following section, staggering one series relative to the other so that upon combining the two series the leading and trailing edge of one series will be offset relative to the leading and trailing edges of the other series, orienting the folded portions of one series relative to the folded portion of the other series so that upon combining only one of the fold lines and trailing edges are exposed, and combining the two series.

2. The method of claim 1 in which the folding of said sections results in an overlap which is no more than $\frac{1}{4}$ the length of each of said preceding and following sections.

3. The method of claim 1 in which the combined sections are subsequently zig-zag folded.

* * * * *